United States Patent [19]

Hill et al.

[11] Patent Number: 4,630,359

[45] Date of Patent: Dec. 23, 1986

[54] METHOD OF MAKING MERCURY CONTAINING REED SWITCHES

[75] Inventors: John Hill, Cincinnati, Ohio; Henryk Turczanski; Cyril E. Coote, both of Kent, England

[73] Assignee: Standex electronics (UK) Limited, Kent, England

[21] Appl. No.: 738,064

[22] Filed: May 24, 1985

Related U.S. Application Data

[63] Continuation-in-part of Ser. No. 400,001, Jul. 20, 1982, abandoned.

[30] Foreign Application Priority Data

Jul. 24, 1981 [GB] United Kingdom ..... 8122946

[51] Int. Cl.[4] ..... H01H 11/02

[52] U.S. Cl. ..... 29/602 R; 29/622; 200/263; 200/266; 335/58; 335/154; 427/11; 427/123; 427/242

[58] Field of Search ..... 29/602 R, 622, 885; 335/58, 196, 151–154; 427/123, 11, 242; 428/929; 200/263, 266

[56] References Cited

U.S. PATENT DOCUMENTS 3,576,415 4/1971 Gywn, Jr. ..... 200/266 X 4,066,859 1/1978 Steinmetz ..... 200/263

*Primary Examiner*—Carl E. Hall

*Attorney, Agent, or Firm*—Weingarten, Schurgin, Gagnebin & Hayes

[57] ABSTRACT

The present disclosure relates to mercury containing reed switches and to methods of preparing switch blades for use in such switches. Heretofore such reed switches have been doped with mercury after the reed switch blades have been mounted in the envelope, the mercury migrating to the contact area of the switch blades, made of a mercury-wettable material, after sealing. The present invention avoids the expense and complexity of this procedure by improving the control of mercury dosing to enable improved performance of such reed switches in low power applications, for example in automatic test equipment, process control equipment and data processing terminals. This is achieved by doubly plating the switch blade tips with mercury-wettable metal, forming a mercury amalgam on the contact area of the switch blades prior to insertion of the blades in the glass envelope, by a process which employs a minimum amount of mercury sufficient for good switch function, subsequently sealing the switch blades into the glass envelope, and conditioning the switch blades in the finished switch.

11 Claims, 5 Drawing Figures

METHOD OF MAKING MERCURY CONTAINING REED SWITCHES

RELATED APPLICATION

This is a continuation-in-part of application Ser. No. 400,001, filed July 20, 1982, now abandoned.

FIELD OF THE INVENTION

The present invention relates to mercury containing reed switches and more particularly to a method of preparing switch blades having minimally amalgamated tips for use in such switches.

BACKGROUND OF THE INVENTION

It is important that reed switches used in a variety of electronic systems and devices such as automatic test equipment, process control equipment and data processing terminals should have very stable and consistent contact resistance over many millions of operations.

Although in most of the above applications the power handled by these switches is very low (less than 100 milliwatts) the very high number of operations during the expected life of the switches brings about gradual deterioration of the contact surface caused by minute electrical transients, mechanical erosion and electrochemical disturbances.

Dry reed switches are known for such applications which incorporate switch blades normally made of nickel/iron plated with a thin layer, about 2 um, of a suitable noble metal such as gold, palladium, rhodium or ruthenium.

During operation of these switches the plated noble metal is eroded by the arc formed on make and break, which causes a steady deterioration of contact resistance and limits the life of the switch.

In order to overcome such deterioration and obtain long-term contact resistance, the blades can be wetted by mercury. In general, only reed switches containing mercury are able to satisfy fully the requirements of contact resistance stability. In such mercury-containing reed switches the blades are provided with, or made of, a mercury-wettable material such as gold or palladium. In practice, the blades are generally mounted within the reed switch and a relatively large quantity of mercury is then introduced into the interior of the switch to form the mercury-wetted contact area.

These switches are difficult to make, expensive, generally have a pressurized hydrogen atmosphere, frequently are position-sensitive, and must have large separations between the contacting elements to permit the surface tension of mercury to be overcome during switch opening. The "all position" mercury-wetted reed switch avoids the position sensitivity of other mercury-wetted reed switches by careful control of the amount of mercury employed, but still suffers from the other drawbacks.

A known mercury-wetted reed switch comprises a pair of switch blades extending within a glass envelope and hermetically sealed therewith. Each switch blade has a spaded end portion the free ends of which overlap to form the switch contact. One of the spaded portions is either wholly or partially plated with a substance wettable by mercury, for example gold, the other blade being non-wettable by mercury except for a very small contact button welded to the blade.

To ensure that the mercury-wettable switch blade is provided with sufficient mercury to produce the contact resistance required, especially under high power applications, the mercury dosage is such as to provide a reservoir of mercury within the envelope.

The presence of such an excessive amount of mercury in the glass envelope has the disadvantage that the reed switch must be operated in a vertical position such that the mercury reservoir is located at the bottom of the capsule and therefore does not swamp the contact area between the blades, thus interferring with contact make and break operations.

Moreover the presence of liquid mercury in the envelope means that during the metal-to-glass sealing procedure, the mercury must be held at an extremely low temperature, down to around minus 50° centigrade, so as to obviate the production of mercury vapour which would affect the seal.

In view of the deficiencies of prior art mercury-wetted switch contacts and switches containing them, it would be very desirable to have a reed switch possessing (1) long-term contact resistance stability equal to that of switches with mercury-wetted contacts, (2) the ability to operate in any orientation, (3) very low adhesion between the contact elements so that the switch can operate with low separation forces and with very small separations between the contacts, and (4) contact elements having unimpaired magnetic properties relative to dry reed switch contacts, so that the switch can operate in the usual way.

SUMMARY OF THE INVENTION

The deficiencies of the prior art are overcome, and reed switches having the desired properties are prepared according to the present invention, which involves a precisely controlled process for making reed switch blades the tips of which are prepared and minimally amalgamated in a unique multistep process not heretofore suggested by the art.

The present invention obviates the problems of the prior art and produces switch contacts having the desired properties by controlling the amount of mercury introduced into the glass envelope so that an extremely thin layer of mercury, sufficient to provide the stability of contact resistance required, is present at the contact area, and by controlling the plating, amalgamation, and conditioning steps of the switch blade preparation process.

This objective has been achieved by the discovery that such switches may be manufactured by introducing mercury precisely to just the contact area of carefully plated and conditioned switch blades, in amalgam form. This has considerable advantages in that firstly the introduced mercury is, at the glass-to-metal sealing stage, remote from the sealing area thus obviating the necessity of sealing under low temperature conditions. Secondly the amount of mercury introduced is controlled, thus obviating mercury wastage and reducing the adhesion, due to surface tension forces, between the mercury layers at the contact areas of the respective switch blades.

All these advantages lead to reduction in cost of manufacture and considerable improvement in performance, enabling switches to be produced having stable contact resistance over at least fifty million operations.

According to the invention there is provided a method of forming a mercury containing reed switch having a pair of switch blades mounted in an hermetically sealed envelope with their free ends in overlapping relationship to form thereat a make and break contact of the switch, characterised in that prior to mounting the switch blades in the envelope the switch blade tips are plated with mercury-wettable metal, heat treated to diffuse the mercury-wettable metal into the underlying switch blade, re-plated with mercury-wettable metal, and coated with a predetermined amount of mercury by rubbing the tips on a mercury-wetted surface. A mercury amalgam is formed on just the tip part of at least one of the switch blades which is to be in contact with the other blade during the make condition of the switch. The switch blades are hermetically sealed into a reed switch in the usual way, and the switch blade tips are then briefly heated by drawing an electric arc across them, to condition them and introduce a small amount of mercury vapor into the switch capsule.

Mercury containing reed switches formed in this way are extremely suitable for use in low level, low power applications. In contradistinction to presently known reed switches which are heavily dosed with mercury after the switch blades have been encapsulated in the switch enveloped, the present invention provides a more simple method of forming the contact area on the switch blades so enabling the reed switches to be more cheaply constructed for low power applications in the computer industry.

Moreover the formation of the amalgam on the switch blades reduces the amount of expended mercury in any given switch which is an important cost reducing factor, improves the life of the switch and reduces the deleterious effects of, amongst other things, mechanical erosion.

DESCRIPTION OF THE DRAWING

The invention will be better understood from a consideration of the detailed description taken in conjunction with the drawing, in which.

DETAILED DESCRIPTION OF THE INVENTION

Reed switch blades are usually thin metal shafts having spade-shaped contact end portions which overlap each other when the blades are mounted in the reed switch. Since the contact area of interest between the switch blades of a reed switch is extremely small, only a fraction of the tip portion of the spaded portion of each of the switch blades need be provided with mercury and this is where the method of the invention has considerable advantages over the prior art.

Figure 1:
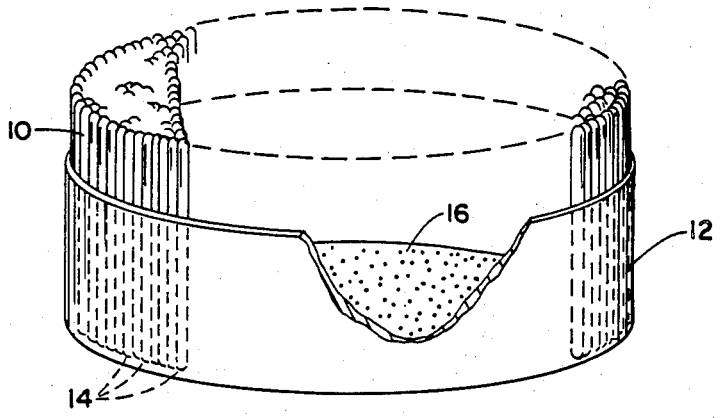
FIG. 1 is a generalized diagram of a container in which switch blades are agitated, tip down, for plating their tips with mercury.

Referring now to FIG. 1, it is seen that a batch of switch blades 10, generally made of nickel/iron and having spaded contact end portions plated with a mercury-wettable metal, generally gold, are placed in a container 12 such that the tips 14 of the spaded portions are in contact with a thin film of mercury which has been deposited on a mercury-wettable substrate, generally gold, at the base 16 of the container.

Figure 2:
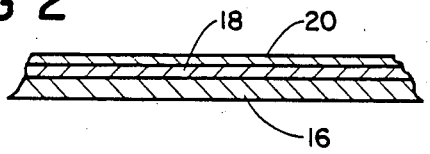
FIG. 2 is a cross-sectional view of the bottom of the container shown in FIG. 1.

As shown in FIG. 2, container base 16 is coated with a layer of mercury-wettable metal 18, such as gold, and this layer is in turn coated with a thin film of mercury, 20. A number of such containers are then eccentrically rotated together for a time sufficient to coat the switch blade tips 14 with mercury and form a mercury gold amalgam at the tips of the spaded portions, coating and amalgamation being effected by rubbing contact between the gold and mercury during the rotation.

Figure 3:
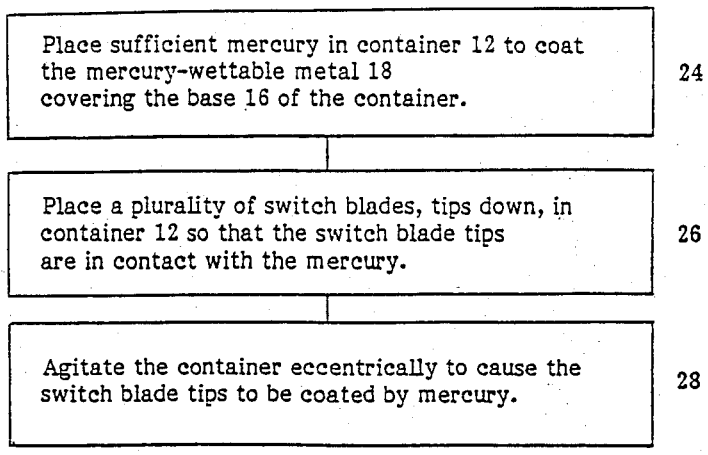
FIG. 3 is a flow chart of the steps of the process for coating switch blade tips with mercury.

As shown in FIG. 3, to adequately amalgamate the tip portions of 3000 blades, a 2 mg amount of mercury is deposited in step 24 onto the mercury-wettable metal 18 covering the base 16 of a container 12 of sufficient size to accommodate 300 loosely packed switch blades, as shown in step 26. Ten such filled containers are together rotated in step 28 eccentrically for a period of approximately two minutes. In this way the tips of the blades are maintained in eccentric rotational rubbing contact with the mercury 20 on the container bottoms 16 and this has been found to be sufficient to coat the mercury onto the switch blade tips and amalgamate the mercury with the mercury-wettable metal, to provide the mercury/amalgam contact area required.

Subsequent to this treatment of the blades, a pair of such blades are mounted in position in a glass envelope and a metal-to-glass seal is effected between the shanks of the switch blades and the glass envelope.

Apart from the layer of metal which forms amalgam with mercury, the performance of the switches described can be further enhanced by introducing additional metals such as tin, copper and silver to the material of the switch blades. This is done to ensure that the formation of nickel-mercury compounds does not occur on the blades which could cause sticking at the contact area.

Figure 4:
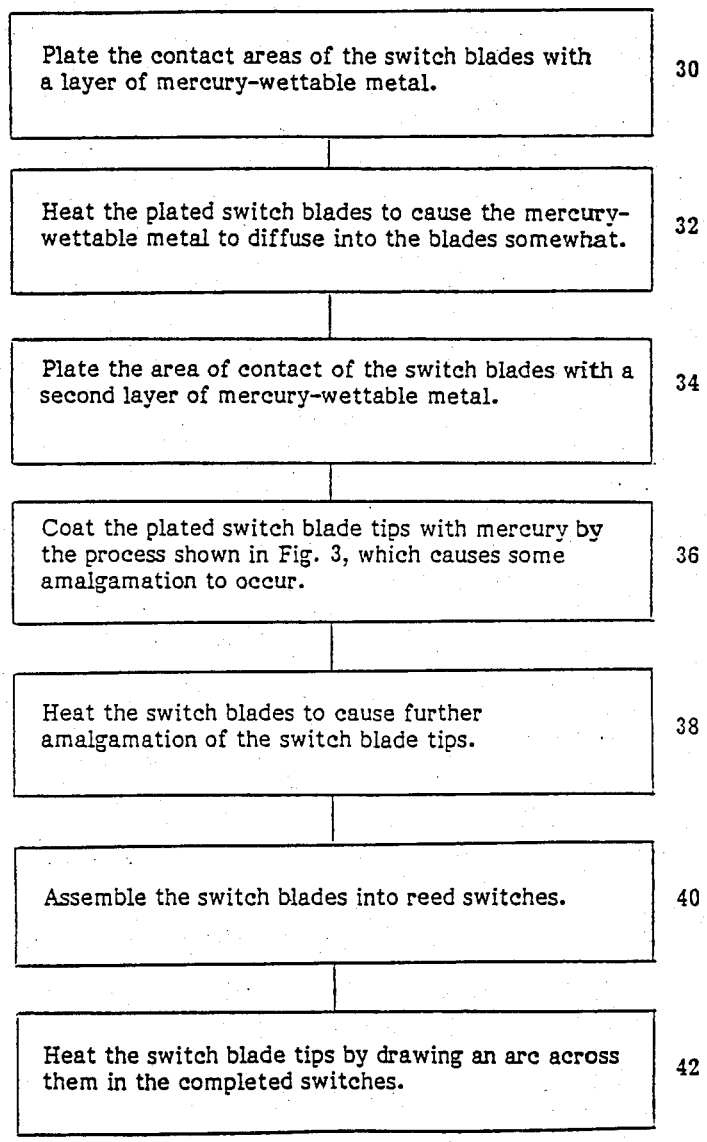
FIG. 4 is a flow chart of the steps of the process for preparing the switch blades of the invention, and reed switches containing them.

More particularly, the superior switch blades and corresponding reed switches are prepared according to the following process, which is illustrated in FIG. 4. Standard reed switch blades are first plated in step 30 in the area of their tips with a layer of mercury-wettable metal, preferably gold, about 0.000025 inches thick. The switch blades are then heated in step 32 to cause the mercury-wettable metal to diffuse somewhat into the blades. In the case of switch blades having gold plated tips, heating step 32 is carried out in an inert atmosphere at about 850° C. for about 30 minutes.

Following heat treatment step 32, the switch blade tips are plated in step 34 with a second layer of mercury-wettable metal, generally gold, this second layer being thinner than the first plated layer. For the case in which this second layer of mercury-wettable metal is gold, the thickness of the second plated layer is about 0.000010 inches.

The doubly plated switch blade tips are then coated in step 36 with a thin layer of mercury covering about 0.025 inches of the tips, as measured from the end of the switch blades, by the process described above and in FIG. 3. In this process, the switch blades 10 are loosely stacked with their tips 14 down in a container 12 which has its bottom 16 coated with mercury-wettable metal 18, generally gold, and which has been provided with a thin layer of mercury 20 covering the container bottom. The switch blades are then agitated in the container 12, causing the switch blade tips 14 to be rubbed in the mercury layer 20 covering the layer of mercury-wettable metal 18 which in turn covers container bottom 16.

This treatment causes the tips 14 of the switch blades to be coated with a thin layer of mercury and also causes some amalgamation of the mercury with the gold plating on the tips.

After the tips 14 of the switch blades have been thus wetted by mercury and partially amalgamated, the switch blades are heated in step 38 to cause further amalgamation of the mercury with the plating covering the switch blade tips. For the case in which the switch blade tips are gold plated, the switch blades are preferably baked for 10 minutes at about 125° C.

The switch blades thus prepared, having their tips doubly plated and amalgamated with a minimal amount of mercury, are then assembled into reed switches using standard assembly machines, as shown in step 40. After assembly of the complete reed switches, and sealing of the glass envelopes, the tips of the switch blades are heated in step 42 by striking an electric arc across the open gap, which conditions the tips and introduces a small amount of mercury into the switch capsules. For the case in which the switch blade tips are gold plated, this final step is preferably carried out by heating the switch blade tip to about 850° C. for about 3 seconds by the striking of an electric arc across the gap.

The contacting surfaces produced using the above process possess mercury layers under one micrometer thick, this amount of mercury being sufficient to provide enough mercury vapor inside the switch capsule to insure stable contact resistance operation over at least 50 million operations when switching low levels of power, for example, 10 volts at 4 milliamperes current, without generating adhesion forces commonly experienced in mercury-wetted reed switches.

Figure 5:
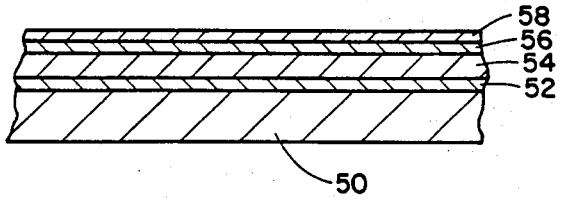
FIG. 5 is a generalized longitudinal cross sectional view of the tip of an amalgamated plated reed switch blade of the invention.

The final switches, shown in cross section in FIG. 5, have a contact resistance under 100 milliohms over 50 million operations when switching power is limited to a maximum voltage of 10 volts dc and a maximum current of 100 milliamperes dc.

The first layer of plating on the switch blade tips is not wetted by mercury in the mercury wetting step because it is covered by the second layer of plating material. This first layer of plating is not amalgamated during the amalgamation step before switch assembly, only the second layer of plating being amalgamated in this step. On the other hand, over the course of time as the reed switch is used, the first layer of plating does react, at each make and break operation, with mercury vapor present inside the switch capsule, thereby generating mercury amalgam in the area of contact.

The second layer of plating on the switch blade tips controls the maximum quantity of mercury introduced into the switch capsule by limiting the volume of amalgam to about $10\times10^{-9}$ cubic inches. This volume figure is derived by multiplying the length of the amalgam coating (0.025 in.) by twice the width of the blade tip (0.040 in.) and multiplying this surface area in turn by the thickness of the layer of amalgam (0.000010 in.).

The reed switches provided by the invention have been shown, under test, to have considerable operational improvements over mercury-wetted reed switches which are doped with mercury by injection techniques, in low power applications.

While the switch blades and the processes of the invention have been exemplified by doubly plating the switch blade tips with gold layers and amalgamating and conditioning the tips under conditions suitable for the preparation of minimally amalgamated gold plated tips, other features and advantages of the present invention will be readily apparent to those skilled in the art without departing from the scope of the invention as defined in the appended claims. In particular other methods of forming the mercury amalgam at the tips of the switch blades can be readily contemplated.

We claim:

1. A method of making amalgamated plated contact blades for reed switches, comprising the following steps:

providing reed switch contact blades having tips which serve as contact areas;

plating the contact areas of said blades with a first layer of gold;

heating the gold plated blades in a first heating step to cause the gold to diffuse into the underlying material;

plating the contact areas of the blades with a second layer of gold;

providing a container having a mercury-wettable inside bottom surface coated with a thin layer of mercury, said container being of sufficient size to hold a plurality of switch contact blades loosely and approximately vertically;

placing said blades, tips down, in said container and agitating the combination of blades and container, causing said switch contact blade tips to rub on said mercury-coated container bottom, to coat the tips of the switch contact blades with mercury and cause some amalgamation of the second layer of gold to occur;

heating the blades in a second heating step to cause further amalgamation of said second gold layer to occur.

2. The method of claim 1 wherein said first layer of gold is approximately 0.000025 inches thick.

3. The method of claim 1 wherein said first heating step is conducted in an inert atmosphere at approximately 850° C. for approximately 30 minutes.

4. The method of claim 1 wherein said second layer of gold is approximately 0.00001 inches thick.

5. The method of claim 1 wherein the mercury-wettable inside bottom surface of said container is gold plating.

6. The method of claim 1 wherein said mercury coating step is conducted by agitating said container for a predetermined time until approximately 0.025 inches of the switch blade tips are wet with mercury.

7. The method of claim 6 wherein said predetermined time is approximately two minutes.

8. The method of claim 1 wherein said second heating step is conducted at approximately 125° C. for approximately 10 minutes.

9. A method for making a reed switch having amalgamated plated contact blades, comprising the following steps:

providing reed switch contact blades having tips which serve as contact areas;

plating the contact areas of said blades with a first layer of gold;

heating the gold plated blades in a first heating step to cause the gold to diffuse into the underlying material;

plating the contact areas of the blades with a second layer of gold;

providing a container having a mercury-wettable inside bottom surface coated with a thin layer of mercury, said container being of sufficient size to hold a plurality of switch contact blades loosely and approximately vertically;

placing said blades, tips down, in said container and agitating the combination of blades and container, causing said switch contact blade tips to rub on said mercury-coated container bottom, to coat the tips of the switch contact blades with mercury and cause some amalgamation of the second layer of gold to occur;

heating the blades in a second heating step to cause further amalgamation of said second gold layer to occur;

hermetically sealing two said switch contact blades into a glass envelope, with said amalgamated plated tips in overlapping relationship, said tips being separated by a gap, the sealed glass envelope constituting a switch capsule; and heating the tips of said switch contact blades by drawing an electric arc across said gap, thereby vaporizing some mercury into the switch capsule and simultaneously conditioning said tips.

10. The method of claim 9 wherein in said heating step said electric arc is maintained between said tips for approximately three seconds.

11. A method of forming a mercury containing reed switch having a pair of switch blades mounted in an hermetically sealed envelope with their free ends in overlapping relationship to form thereat a make and break contact of the switch, characterized in that prior to mounting the switch blades in the envelope a mercury amalgam is formed on a part of at least one of the switch blades which is in contact with the other blade during the make condition of the switch;

each of said switch blades having a gold plated spaded portion the tip of which is rubbed in mercury for a predetermined time period to form said amalgam;

said rubbing step being accomplished by loosely packing a batch of approximately 300 of said gold plated blades in a container having a base mercury-wetted with about 2 mg. of Hg with which said tips make contact, one or more of such packed containers being eccentrically rotated such that the tips move correspondingly over the base of the or each container to form the amalgam.

* * * * *